United States Patent [19]

Slingerland, Jr.

[11] 4,117,627

[45] Oct. 3, 1978

[54] ROTATABLE STAND

[76] Inventor: Henry H. Slingerland, Jr., 2800 Ramona Ct., Wilmette, Ill. 60091

[21] Appl. No.: 803,342

[22] Filed: Jun. 3, 1977

[51] Int. Cl.[2] ..... A47G 7/00

[52] U.S. Cl. ..... 47/39; 108/103; 248/349

[58] Field of Search ..... 47/66, 39; 248/349; 108/94, 103, 105, 59, 153, 157, 159

[56] References Cited

U.S. PATENT DOCUMENTS

| | | | |
|---|---|---|---|
| 559,161 | 4/1896 | Brower | 108/103 |
| 1,859,352 | 5/1932 | Albee | 248/349 X |
| 4,026,067 | 5/1977 | Wengel | 248/349 X |

*Primary Examiner*—E.H. Eickholt

*Attorney, Agent, or Firm*—Wegner, Stellman, McCord, Wiles & Wood

[57] ABSTRACT

A freely rotatable, effectively tilt-free stand for carrying plants and the like. The stand includes a plurality of relatively rotatable members cooperatively defining a ball bearing structure wherein the ball bearings are disposed in an annular array at the periphery of the assembly so as to provide an effectively tilt-free rotation thereof. Support of the structure relative to the bearings is effected by metallic bearing plates which may be adhesively secured to other elements of the structure. The base member may have a lateral extent substantially greater than that of the rotatable portions to provide further tilt-free stability.

8 Claims, 3 Drawing Figures

ROTATABLE STAND

BACKGROUND OF THE INVENTION

1. Field of the Invention

This invention relates to rotatable supports and in particular to rotatable stands.

2. Description of the Prior Art

In the placement of house plants and the like, it is desirable to effect rotation thereof so as to present different portions to view or to source of light.

A number of rotatable stands have been developed which are adapted to permit rotation of the object carried thereby. Where the object is a plant, it is desirable to effectively maintain a tilt-free disposition of the plant. It is further desirable to provide facilitated, freely adjustable rotation of the stand while yet permitting the stand to carry a substantial weight, such as of potted plants and the like.

The known plant stands do not fully satisfy the above requirements and have the further disadvantage of relatively high cost and maintenance requirements.

SUMMARY OF THE INVENTION

The present invention comprehends an improved freely rotatable, effectively tilt-free plant stand avoiding the problems of the prior art plant stands in a novel and simple manner.

More specifically, the present invention comprehends such a plant stand having improved means for supporting the plant for rotation on a base member.

In the illustrated embodiment, the plant stand is defined by the base member, a metal lower bearing plate facially secured to the base member, a ball race plate facially superposed to the lower bearing plate and having an annular array of circumferentially spaced peripheral through holes, a metal upper bearing plate facially superposed to the ball race plate, a plurality of ball bearings received one each in the holes and having a diameter greater than the thickness of the ball race plate to have rolling engagement with each of the lower and upper bearing plates, an axle member upstanding from the base member and projecting through the lower bearing plate, the ball race plate coaxially of the annular array, and the upper bearing plate for providing coaxial rotation of the upper bearing plate on the ball bearings in the annular array, and a mounting plate facially secured to the upper bearing plate for rotation therewith coaxially of the array.

Further more specifically, in the present embodiment, the bearing plates and ball race plate comprise congruent circular discs. The lower bearing plate may be adhesively secured to the upper surface of the base member and the upper bearing plate may be adhesively secured to the lower surface of the mounting plate.

The axle may project through the upper bearing plate. In the illustrated embodiment, the axle extends through a center opening in the mounting plate.

The axle may be inserted partially downwardly into the base member to extend accurately perpendicularly upwardly from the upper surface thereof. In the illustrated embodiment, each of the base member and plates defines parallel upper and bottom flat surfaces so that the support of the plant thereon is accurately parallel to the horizontal surface on which the plant stand is to be placed.

In the illustrated embodiment, the ball race plate, the upper bearing plate, and the mounting plate are rotatable freely about the axle.

Further in the illustrated embodiment, the base member may be formed as a disc member with the plates comprising congruent disc elements having a diameter smaller than the diameter of the base member.

The plant stand of the present invention is extremely simple and economical of construction while yet providing an improved, freely rotatable, effectively tilt-free support of a plant or the like.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 2:
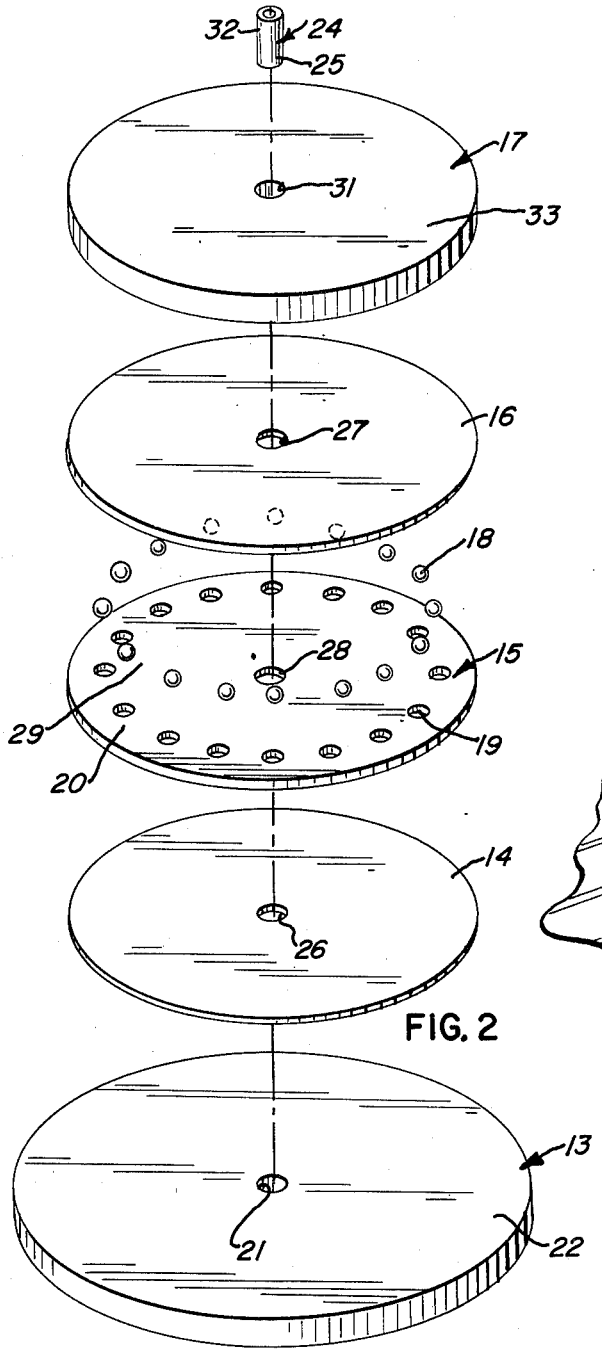
FIG. 2 is an exploded perspective view illustrating the structural elements of the plant stand.
Figure 1:
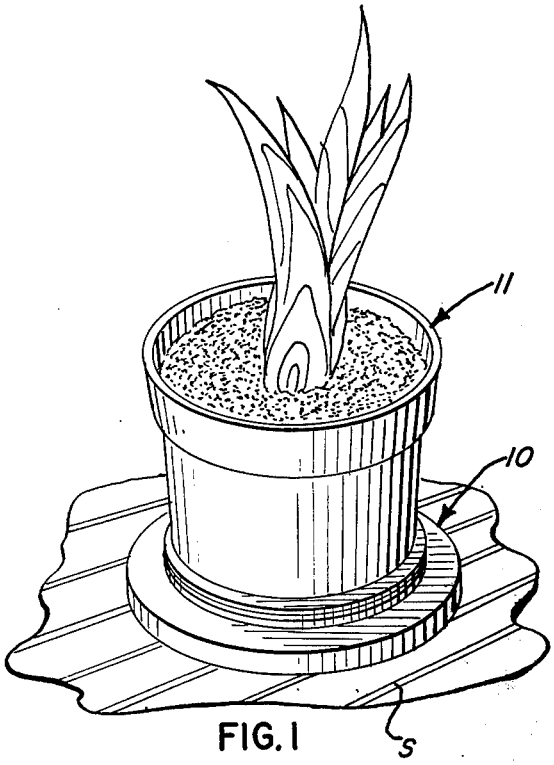
FIG. 1 is a perspective view of a plant stand embodying the invention carrying a potted plant thereon.
Figure 3:
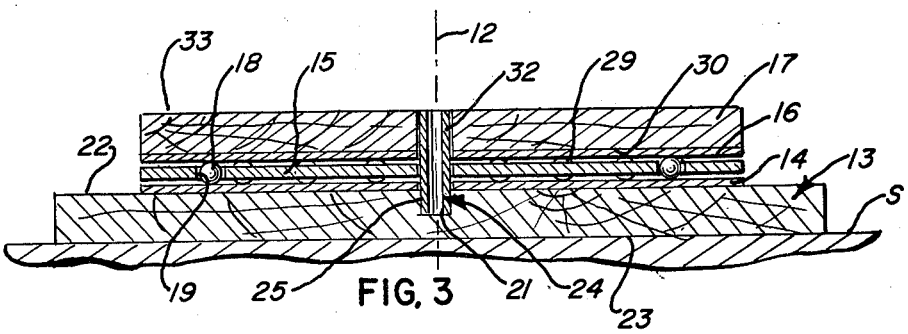
FIG. 3 is a diametric section thereof.

In the exemplary embodiment of the invention as disclosed in the drawing, a plant stand generally designated 10 is arranged to support a potted plant 11, or the like, for freely rotatable, effectively tilt-free disposition. The plant stand is adapted to be placed on any suitable horizontal surface, such as surface S illustrated in FIG. 1, so as to provide for facilitated selective rotation of the plant 11 about an accurately vertical rotational axis 12, as shown in FIG. 3.

More specifically, the plant stand of the present invention includes a base member 13, a lower bearing plate 14, a ball race plate 15, an upper bearing plate 16, and a mounting plate 17.

A plurality of ball bearings 18 are disposed one each in a corresponding plurality of holes 19 in the peripheral portion 20 of the ball race plate 15.

Base member 13 is provided with a cylindrical recess 21 opening upwardly through an upper surface 22 thereof, which, in the illustrated embodiment, is made to be accurately parallel to a lower surface 23 thereof. As shown in FIG. 3, the recess extends partially downwardly into the base member.

An axle member 24 includes a lower end portion 25 fitted in the recess 21 so as to cause the axle to extend accurately perpendicularly upwardly from base member surface 22, as shown in FIG. 3. The axle member may be sized to have a force fit with the base member in recess 21. In the illustrated embodiment, the axle member is formed of metal and the base member is formed of wood to provide a firm grip of the axle member and maintain accurate perpendicular extent thereof.

In the illustrated embodiment, each of the lower bearing plate 14 and upper bearing plate 16 is formed of metal and may comprise a circular disc having a diameter smaller than the diameter of the base member 13, as shown in FIG. 3. Lower bearing plate 14 is provided with a central hole 26 and upper bearing plate 16 is provided with a corresponding central hole 27.

Ball race plate 15 is provided with a similarly corresponding hole 28. The annular array of holes 19 is concentric of hole 28 and is preferably closely adjacent to the distal edge of the ball race plate in peripheral portion 20 thereof.

As shown in FIG. 3, ball bearings 18 preferably have a diameter greater than the thickness of ball race plate 15 so as to support the upper bearing plate 16 for free rotation about axis 12 and axle member 24 in slightly spaced facial superposition relative to the upper surface 29 of the ball race plate 15.

In the illustrated embodiment, lower bearing plate 14 may be adhesively secured in coaxial relationship to the bearing surface 22 and upper bearing plate 16 may be adhesively secured to the lower surface of mounting plate 17. The ball race plate may be formed of a suitable material, and in the illustrated embodiment, is formed of wood, having a thickness somewhat greater than that of the metal bearing plates 14 and 16. As shown in FIG. 3, the holes 19 may have a diameter slightly larger than the diameter of the ball bearings 18 to permit free rotation of the bearings therein while yet effectively locating the bearings in circumferentially spaced relationship in the annular array.

In the illustrated embodiment, the mounting plate 17 is relatively thick and may be formed of a material, such as wood, for supporting the plant 11. The upper mounting plate may be provided with a central opening 31 aligned with opening 27 of the top bearing plate to receive an upper portion 32 of the axle member and cooperate with upper bearing plate 16 to provide a coaxial rotation thereof about the axis 12. In the illustrated embodiment, the axle member portion 32 extends fully upwardly through the hole 31 to terminate flush with the upper surface 33 of the support member.

In the illustrated embodiment, the plates 14, 15, 16 and 17 define congruent discs having planar upper and lower surfaces with the axle member 24 maintaining the discs in coaxially aligned superposed relationship. Opening 31 may be slightly larger than the outer diameter of axle member portion 32 so that the mounting plate, together with the bearing plate 16 secured thereto may be removed to provide access to the ball race plate and ball bearing 18 as desired. As will be obvious to those skilled in the art, opening 31 may be sized to have a slight friction fit with the axle member portion 32 as desired.

Thus, the plant stand 10 of the present invention provides an improved, freely rotatable, effectively tilt-free support of an article, such as plant 11, permitting different aspects of the plant to be presented as desired while yet effectively maintaining the vertical arrangement thereof in all rotational positions. By effecting such accurate tilt-free rotation, the extremely free rotation permitted by the ball bearings may be effected while yet assuring that the plant stand and plant carried thereby will be retained in the selective disposition without a tendency for the plant to turn further upon completion of the positioning operation.

The foregoing disclosure of specific embodiments is illustrative of the broad inventive concepts comprehended by the invention.

I claim:

1. A freely rotatable, effectively tilt-free plant stand comprising:

a base member;

a metal lower bearing plate facially adhesively secured to said base member and having a small central opening;

a ball race plate formed of wood facially superposed to said lower bearing plate and having an annular array of circumferentially spaced peripheral through holes;

a metal upper bearing plate facially superposed to said ball race plate and having a small central opening;

a plurality of ball bearings received one each in said holes and having a diameter greater than the thickness of said ball race plate to have rolling engagement with each of said lower and upper bearing plates;

an axle member fixedly secured to said base member and projecting upwardly therefrom freely through said lower bearing plate opening, said ball race plate coaxially of said annular array, and said upper bearing plate opening for maintaining free coaxial rotatability of said upper bearing plate on said ball bearings in said annular array; and a mounting plate facially adhesively secured to said upper bearing plate for rotation therewith coaxially of said array.

2. The freely rotatable, effectively tilt-free plant stand of claim 1 wherein said bearing plates and ball race plate comprise congruent circular discs.

3. The freely rotatable, effectively tilt-free plant stand of claim 1 wherein said axle projects upwardly from said upper bearing plate.

4. The freely rotatable, effectively tilt-free plant stand of claim 1 wherein said mounting plate defines an upper surface, said axle projects upwardly from said upper bearing plate and through said mounting plate to terminate at its upper end substantially flush with said upper surface of the mounting plate.

5. The freely rotatable, effectively tilt-free plant stand of claim 1 wherein said axle extends partially downwardly through said base plate.

6. The freely rotatable, effectively tilt-free plant stand of claim 1 wherein each of said base member and plates defines parallel upper and bottom flat surfaces.

7. The freely rotatable, effectively tilt-free plant stand of claim 1 wherein said ball race plate, upper bearing plate, and mounting plate are freely rotatable about said axle.

8. The freely rotatable, effectively tilt-free plant stand of claim 1 wherein said base member comprises a disc member, and said plates comprise congruent disc elements having a diameter smaller than the diameter of said base member.

* * * * *